US005601374A

United States Patent [19]

Cavagnolo

[11] Patent Number: 5,601,374

[45] Date of Patent: Feb. 11, 1997

[54] ENDLESS INK RIBBON CARTRIDGE WITH PROTECTED RIBBON SPLICE, AND A PROTECTION ARRANGEMENT THEREFOR

[75] Inventor: Gianpaolo Cavagnolo, Milan, Italy

[73] Assignee: Bull HN Information Systems Italia S.p.A., Turin, Italy

[21] Appl. No.: 540,646

[22] Filed: Oct. 11, 1995

[30] Foreign Application Priority Data

Nov. 25, 1994 [EP] European Pat. Off. ..... 94830549

[51] Int. Cl.[6] ..... B41J 33/00

[52] U.S. Cl. ..... 400/247; 400/194; 400/703; 324/686

[58] Field of Search ..... 324/658, 667, 324/676, 686; 400/247, 249, 194, 703

[56] References Cited

U.S. PATENT DOCUMENTS

| | | | |
|---|---|---|---|
| 4,371,116 | 2/1983 | Sage et al. | 239/720 |
| 4,939,445 | 7/1990 | Meline et al. | 324/663 |

FOREIGN PATENT DOCUMENTS

| | | |
|---|---|---|
| 0071726 | 2/1983 | European Pat. Off. . |
| 59-011564 | 1/1984 | Japan . |
| 63-114683 | 5/1988 | Japan . |
| 2-128888 | 5/1990 | Japan . |
| 4303674 | 10/1992 | Japan . |

*Primary Examiner*—John S. Hilten
*Attorney, Agent, or Firm*—Rosen, Dainow & Jacobs, L.L.P.

[57] ABSTRACT

An endless ink ribbon cartridge with protected splice of the endless ribbon, wherein a reactance detector element housed in the cartridge at a location close to a predetermined travel path of the ink ribbon increases its reactance as a conductive strip disposed on the ribbon at a predetermined location relative to the splice moves close past the detector element, the reactance increase being detected by a protection arrangement external of the cartridge to prevent printing operations from being carried out through said splice.

7 Claims, 4 Drawing Sheets

ENDLESS INK RIBBON CARTRIDGE WITH PROTECTED RIBBON SPLICE, AND A PROTECTION ARRANGEMENT THEREFOR

DESCRIPTION

The present invention relates to an endless ink ribbon cartridge with protected ribbon end splice, as well as to a protection arrangement therefor.

BACKGROUND OF THE INVENTION

It is known that impact printers in data processing systems use ink ribbon cartridges wherein an endless ribbon is caused to run along a print line always in the same direction, in order to ensure continuity of the printing operation and make the ribbon drive more reliable and economical.

The operation of impression members, usually wires in a printhead, causes the ribbon to wear gradually such that its service life is shortened even where re-inking devices are provided.

Especially the area of the spliced ends of the endless ribbon is affected by wear and liable to break long before the ribbon is actually spent.

As a result, the practical service life of the ribbon becomes restricted to a few millions characters, and there exists a risk of the ribbon and the impression members jamming with serious consequences for the printing apparatus.

To avoid such problems, devices have long been proposed for detecting the splice in the ribbon before it reaches the print line and discontinuing the impression operations while the splice area is facing the printing members, so as to prevent wear and damage in this area.

For instance, publication EP-A-0071726 discloses a protection device comprising a pair of pinch rollers which are entrained rotatively by the ribbon travelling therebetween.

An opening is provided in the proximities of the splice whereby, when the opening locates between the two rollers, the ribbon is no longer held in the roller nip and its entraining effect on the rollers is discontinued.

The rotation of one of the rollers can be sensed using optical sensors or sensors of some other types to provide indications of the ribbon being either in motion or at a standstill, and of the opening moving past between the rollers.

Thus, the operation of the printing apparatus can be stopped on the occurrence of a jammed condition, or the printing operations can be discontinued upon the presence being sensed of the splice before the impression members.

That device is a fairly expensive and mechanically complicated in construction to incorporate to the inked ribbon cartridge, whereas if provided externally, it involves considerable problems of installation and removal of the ribbon cartridge, and still greater design problems where the cartridge is of the type pivoted on a support.

It has also been proposed of using a conductive material arranged on the ribbon proximate to its end so as to close an electric circuit and reveal the presence of the splice.

Despite its simplicity, this solution is low in reliability because the ink not infrequently includes oily substances which are non-conductive and can form insulative coatings as may affect electric contact.

SUMMARY OF THE INVENTION

This problem is obviated by the endless inked ribbon cartridge with protected end splice according to the present invention, wherein the cartridge comprises an electric detector element of the capacitive or inductive reactance type placed in the path of the inked ribbon, and the inked ribbon carries a material proximate to the splice which is effective to change the reactance characteristic of the element without the need to establish an electric contact with the ribbon.

According to a particular aspect of the invention, the electric reactance detector element comprises a pair of conductive plates, adjacent to but not facing each other, and the material carried on the inked ribbon proximate to the splice is a conductive material (metal foil or conductive ink) forming, in combination with the two conductive plates, a pair of capacitors in series with each other.

Advantageously, one of the conductive plates also forms a friction pad for tensioning the inked ribbon.

Advantageously, the variable reactance electric element of the inked-ribbon cartridge is connected in an electronic compare circuit for comparison with a reactance reference which is controlled to follow the changes in reactance of the measuring element with a transfer function control loop having a much greater time constant than the reactance rate of change of the measuring element caused by the reactance changing material on the running ribbon.

BRIEF DESCRIPTION OF THE DRAWINGS

The features and advantages of the invention will be more clearly apparent from the following description of a preferred embodiment thereof and the accompanying drawings, in which.

DESCRIPTION OF THE PREFERRED EMBODIMENT

Figure 1:
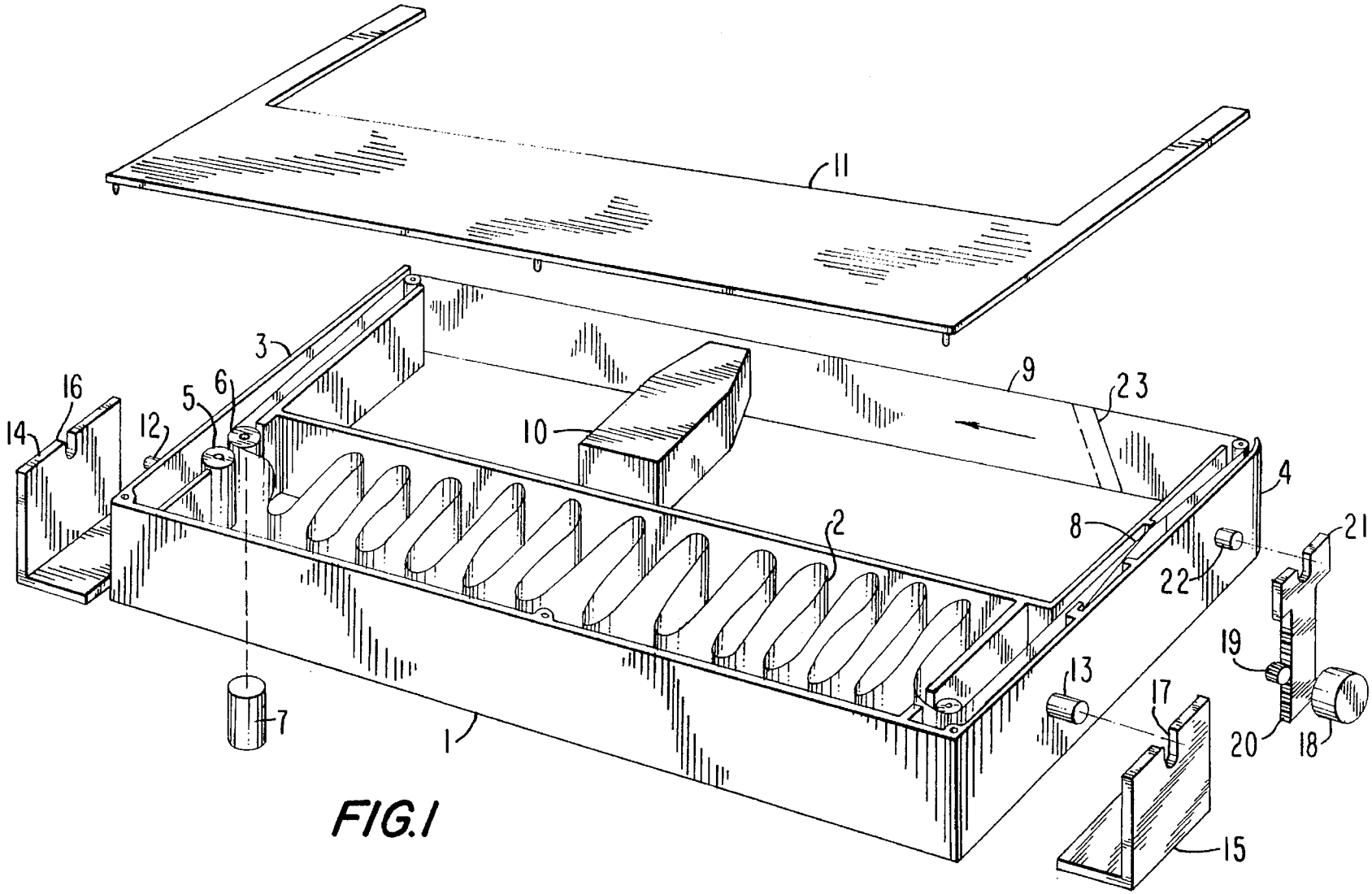
FIG. 1 shows in exploded perspective view a conventional inked ribbon cartridge and the printer parts which interact with it.

To make the invention better understood, FIG. 1 shows an exploded perspective view of an endless ink ribbon cartridge of a known type, directed to better bring out the simple constructional alterations made necessary by the present invention.

The cartridge comprises a hollow box-type body 1 containing the inked ribbon 2 and being in the form of an elongate right parallelepipedon, and two end arms 3, 4 which extend parallel to each other and perpendicularly to the long dimension of the box-type body.

The ends of the arms 3 and 4 are open.

The endless ink ribbon enters the housing through the open end of the arm 3 under the drive of two pinch rollers 5, 6, at least one of which is rotated by a motive means 7 outside the cartridge, and is taken up inside the cartridge housing in a random fashion to ultimately leave the cartridge housing through the open end of the arm 4.

The arm 4 accommodates an elastic friction pad 8 which holds the outgoing ink ribbon from the arm 4 pressed against a wall of the arm 4.

Under the bias of the pad 8 and the entrainment by the pinch roller pair 5, 6, a portion of the ribbon 9 is suitably stretched between ends of the arms 3, 4 and is constantly renovated at a drive speed which is typically on the order of 10 cm/sec.

A printhead 10 is accommodated between the ribbon portion 9 and the box-type body 1 and reciprocated between the arms 3 and 4.

The printing elements of the printhead urge the inked ribbon 9 locally against a print support, not shown, to impress dots thereon.

The box-type body 1 is molded from plastics by thermo-compression, and is covered by a plastics cover 11 attached to the body by thermo-welding, gluing or pins driven into sockets in the box-type body or even by screws or rivets.

Also known are inked ribbon cartridges of smaller size wherein a printhead receiving space is formed between the two arms 3 and 4 and houses the printhead in a fixed position relative to the cartridge which, in this example, would be traversed along with the printhead.

In either cases, the inked ribbon cartridge is generally secured, by mounting pins 12, 13 in a line along a parallel axis to the direction of lay of the ribbon portion 9, on two holders 14, 15 attached to the frame of the printing machine (or to a print carriage) and provided with saddles 16, 17 for force fitting the pins 12, 13 which act as bearing pins about which the cartridge is allowed to pivot.

In a known manner, e.g. using drive members 18 coupled through a pinion 19 and rack 20 to a drive fork 21 in which a pin 22 located on the arm is fitted, the ribbon cartridge can be rotated about the axis defined by the pins 12, 13 so as to bring one of a plurality of parallel inked bands formed on the ribbon into the gap between the printhead 10 and the print support.

The bands may have different colors to enable printing in different colors, and if of the same color, provide enhanced service life for the ribbon.

With both cartridge types, the technical problem to be solved is that of detecting the splice 23 between the ends of the inked ribbon immediately before the splice 23 appears in the ribbon portion 9, so as to allow the printing operations to be inhibited for the time required by the splice 23 to travel the distance between the two ends of the arms 3, 4, and prevent impression operations from being attempted through the splice.

Preferably, the splice 23 should be detected, in relation to the travel speed of the inked ribbon, at a sufficiently early time to permit completion of a printing operation currently being carried out along a line of print.

Figure 2:
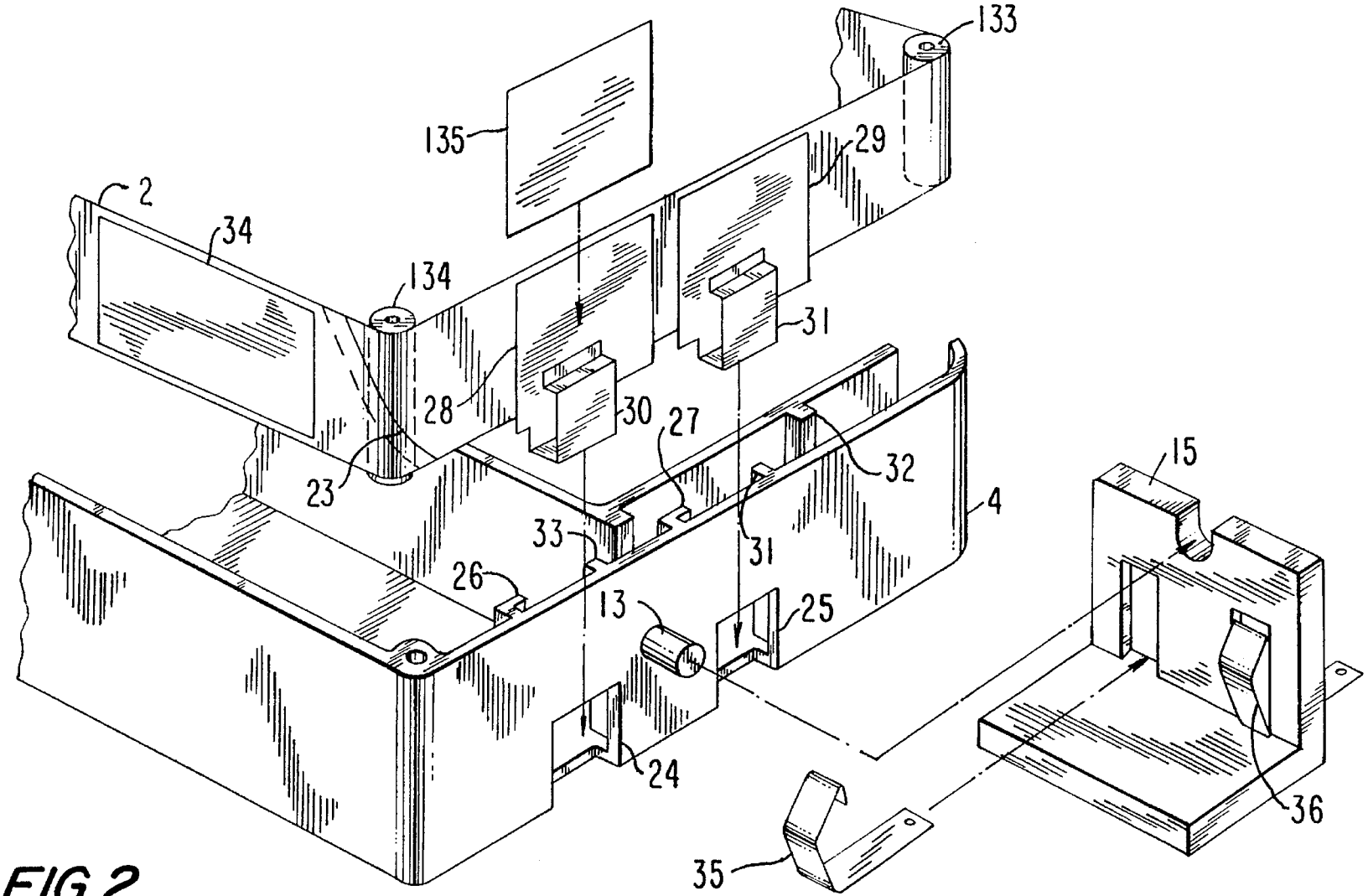
FIG. 2 shows in exploded perspective view a portion of the cartridge in FIG. 1, as modified in accordance with a preferred embodiment of the present invention.

FIG. 2 is an exploded perspective view showing a portion of an inked ribbon cartridge and one of the cartridge holders with the modifications provided for by a preferred embodiment of the present invention.

Formed on the outward face of the arm 4 whence the inked ribbon comes out, during the box-type body molding step and without involving any additional operations, are two openings 24, 25 located close to the pin 13.

Also formed inside the arm 4 are retaining guides 26, 27 wherein an edge, respectively of a first rectangular metal plate 28 and a second rectangular metal plate 29, fits slide-fashion.

The two plates are preferably, but not necessarily, identical with each other and formed from a resilient material such as stainless steel, phosphor bronze, and the like.

The two plates 28, 29 are each provided with a tab 30, 31 bent into a U-shape which, as the plates are fitted into their respective retaining guides 26, 27, snap irreversibly into the openings 24 and 25 to form a contact pad for contacting electric connection terminals on the cartridge outside.

Ribs inside the arm 4, such as 32*a*, 32*b*, on which a middle section of the plate 29 and the remote edge from that fitted into the guide 27 bear respectively, on opposed sides of the plate 29, impose a state of elastic pre-load on the plate 29.

In this way, the plate 29 functions as a friction pad for inked ribbon intervening between the plate 29 and the rib 32*b*.

A similar rib 33, on which a middle section of the plate 28 is arranged to bear, can advantageously enable it to perform the same function.

Thus, it will be apparent how the inked ribbon 2 is made to run close to the two plates and in partial contact with at least one of them along a predetermined path which is substantially straight and imposed by two guide rollers 133, 134 provided at the outlet of the arm 4 and a corner of the housing, respectively.

The two side-by-side plates form each a first plate of first and second capacitors.

The second plate of either capacitors consists of a conductive strip 34 which is formed on the inked ribbon and extends on the ribbon for a sufficient length to permit of it simultaneously overlapping at least a portion of both plates 28 and 29 and preferably the entire plate dimension along the running direction of the inked ribbon.

The conductive strip 34 can be formed on the ribbon by application of a conductive ink which would harden when dried or cured, as well as by rolling and gluing on a thin flexible foil of metal.

The ink application can be carried out on the opposite face of the ribbon from that exposed on the metal plates 28, 29, so that the ribbon can itself provide electric insulation between the plates and the conductive strip 34.

It would also be possible to arrange the conductive strip 34 on the same face of the ribbon as the face exposed on the metal plates, in which case either an insulative coating would be provided for the strip 34 (also to be obtained by ink application or lamination of a plastic sheet 9) or a dielectric coating on at least one of the plates (to be obtained by lacquer, ink application or lamination) as represented in FIG. 2 by an insulating film 135 applied on the plate 28.

Whether applied to the ribbon or both plates 28, 29, or when the plate 28 is also to function as a friction shoe, the insulating film is preferably made of a wear-resistant material, such as polyurethane or polyester resin.

It is apparent, therefore, that while the direct capacitive coupling of the two side-by-side plates 28, 29 is negligible, as the strip 34 moves past the two plates 28 and 29, two capacitive structures (or at least one, if one of the plates is in electric contact with the strip 34) are created in series with each other, resulting in significantly increased relative capacitance of the structure even though the absolute capacitance would be small, on the order of a few picofarads.

The conductive strip 34 on the inked ribbon may be formed upstream or downstream of the splice 23 relative to the running direction of the ribbon, or formed so as to overlie the splice.

The change in capacitance of the structure just described due to the ribbon movement, can be detected by external electronic circuits of the cartridge to provide an indication of the splice 34 position before the splice presents itself in the exposed ribbon portion 9.

The connection of the varying-capacitance capacitive structure to external electronic circuits can be readily accomplished using elastic reed contacts 35, 36 housed in suitable sockets in the holder 15, which contacts should be in contact with the tabs 30, 31, respectively.

The conductive reeds 35, 36 are also connected, preferably by soldering, to the terminals of the electronic circuit.

Figure 3:
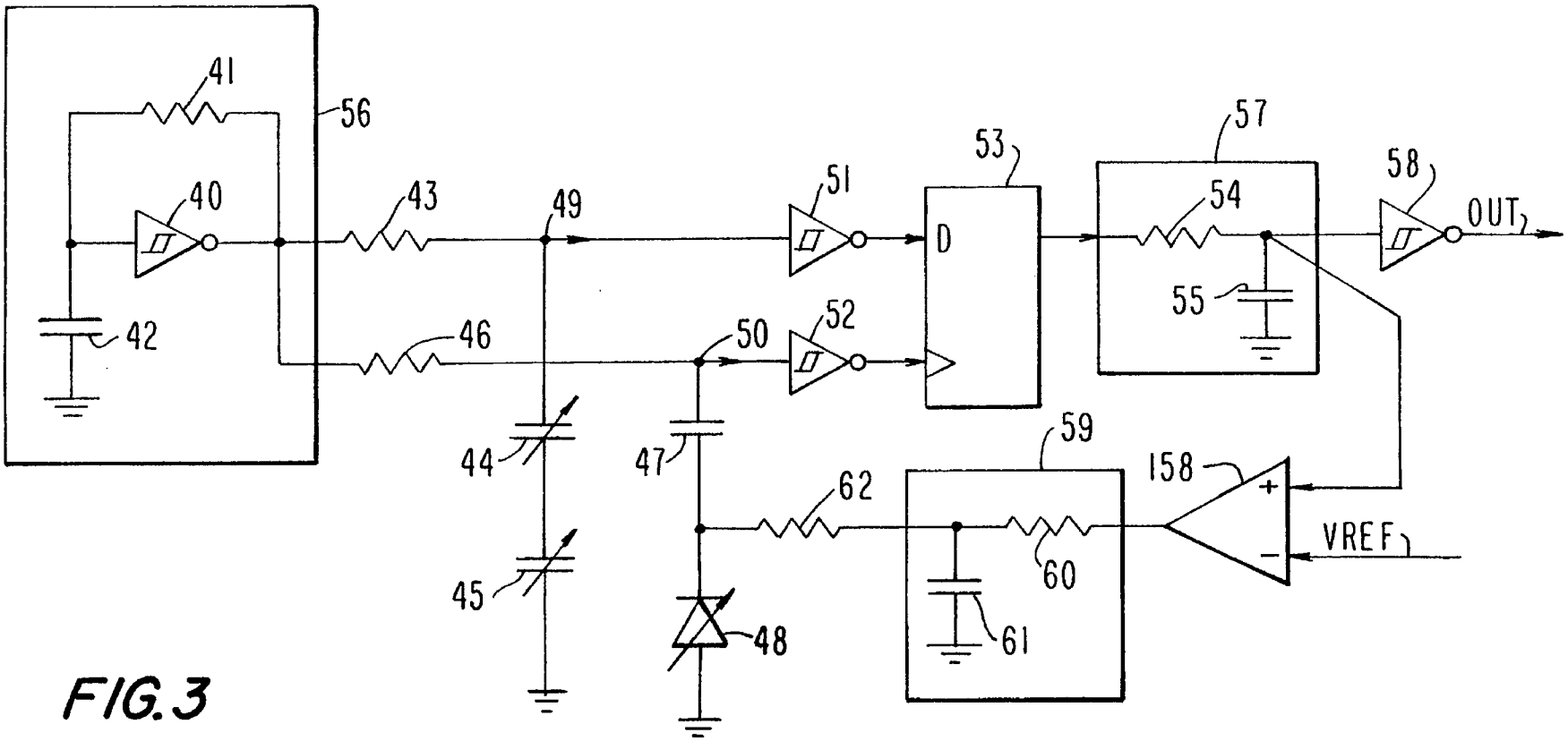
FIG. 3 is a wiring diagram of a preferred embodiment of the protection arrangement for the cartridge in FIG. 2.

FIG. 3 shows a schematic wiring diagram for a preferred embodiment of the electronic circuit recognizing the changes in capacitance of the detector element.

A square-wave oscillator 58 is formed by a hysteresis type inverter (or Schmitt trigger) 40 having an input coupled to the output through a resistor 41 and grounded through a capacitor 42.

The time constant RC of the circuit sets the oscillation period, which can be conveniently selected from a wide range, e.g. between 10 and 100 kHz.

The output signal from the inverter 40 is input to a first integrator network formed of a resistor 43 and the capacitor pair 44, 45 in series of the detector element described hereinabove. It is also input to a second integrator network formed of a resistor 46 and two serially-connected capacitors 47, 48 of which one, connected to ground, consists of the variable capacitance of a reverse-biased diode VARICAP.

The output 49 of the first integrator or measuring network is connected to the input of a hysteresis type inverter 51.

The output 50 of the second integrator or reference network is connected to the input of a hysteresis type inverter 52.

A flip-flop 53 of the D type has the D input connected to the output of the inverter 51 and the clock input connected to the output of the inverter 52.

Dependent on whether the time constant T1 of the measuring network is greater or smaller than the time constant T2 of the reference network, the flip-flop 53 will be se t or reset at each transition of the inverter output 52 from a low to a high level.

The forward output of the flip-flop 53 is connected to the input of the integrator network 57 formed of a resistor 54 and a capacitor 55.

The time constant T3 of the network 57 is at least one order of magnitude greater than the oscillation period of t he oscillator 56.

The output of the integrator network 57 is connected to the input of a hysteresis type inverter 58.

The time constant T2 of the reference integrator network is s et to be greater than the time constant T1 that characterizes the measuring network when the plates 28, 29 (FIG. 2) of the measuring element are capacitively uncoupled, and smaller than the time constant imposed on the measuring network by the conductive strip 34 (FIG. 2) overlying the plates of the measuring element.

Under such conditions, the flip-flop 53 is consistently set at each period of the oscillator excepting during the time interval, much longer than T and on the order of 100–500 msec, when the conductive strip 34, due to the movement of the inked ribbon, is overlying the plates 28, 29, thereby increasing the time constant of the measuring network.

During this time interval, the flip-flop 53 is reapeatedly reset, so that the output voltage from the integrator network 57 will decrease gradually until it switches the output of the inverter 58 to an electric high.

This signal at an electrically high level provides an indication that the ribbon splice has moved past a predetermined position, and can be used to temporarily discontinue with due timing, the printing operations.

This control arrangement, albeit practicable, is an extremely critical one and requires that the time constant of the reference network be adjusted with the utmost accuracy.

In addition, It cannot accommodate variations in the electric characteristics of the components due, for example, to ageing and changes in temperature.

Advantageously, therefore, the output signal from the integrator network 57 is used as a feedback signal for controlling, through a feedback network, the time constant T2 of the reference network by imposing to the reference network a varying time constant T2 which follows, with suitable inertia, the changes in the time constant T1 of the measuring network.

The feedback network comprises an amplifier 158 of suitable gain which has a non-inverting input connected to the output of the network 57 and an inverting input connected to a predetermined reference voltage VREF, higher than the lower changeover threshold of the hysteresis inverter 58.

The output of the amplifier 158 is connected to the input of an integrator network 59 formed of a resistor 60 and a capacitor 61.

The time constant T4 of the network 59 is conveniently greater than T3 of the network 57.

The output of the network 59 is connected, via an isolation resistor 62, to the cathode of the diode 48 and is reverse -biased with a varying positive voltage controlled by the feedback loop.

The operation of the control arrangement is quite straightforward: when the time constant T1 of the measuring network is small, the flip-flop 53 is regularly set and the output voltage from the integrator network 57 tends to increase above the reference voltage VREF input to the amplifier 158.

Correspondingly therewith, the output voltage from the network 59 tends to increase, although at the slow rate imposed by the network time constant T4.

The reverse bias voltage applied to the diode 48 increases and its capacitance decreases.

This causes the time constant T2 of the reference network to decrease.

With T2 smaller than T1, the flip-flop 53 is reset, and the output voltages from the network 57 and the network 59 decrease, so that the constant T2 is again increased.

In this way, the detection arrangement is imposed a cut-in threshold which will match, over time and at a suitably slow rate, the characteristics of the measuring network.

When the time constant T1 of the measuring network changes rather sharply due to the conductive strip moving past the plates 28, 29, the inertia of the control arrangement will not allow the time constant T2 to adjust itself for the new value, and the flip-flop 53 will be held in the reset state for a sufficient time length to allow the integrator network 57 to become discharged and the inverter activated.

For simplicity, the diagram of FIG. 3 shows no discharge components for the integrator networks, which should obviously be provided if the input and load impedances of the networks are not sufficiently low to allow discharging at a desired time constant.

It will be appreciated that the diagram of FIG. 3 only illustrates a preferred embodiment, and that many modification may be made.

For example, the forward input of the amplifier 158 may be connected to the output of the flip-flop 53 rather than to the output of the network 57.

The amplifier 158 may be constructed using discrete components such as transistors, or alternatively, all the active components and the resistors may be formed in a single integrated circuit.

All these modifications, once the basic concept of the control arrangement has been explained, ought to be obvious for the skilled ones.

The foregoing description relates to a protection arrangement that employs a capacitive reactance type of detector element and requires no electric connections established through the inked ribbon.

Incidentally, any shorting of one of the capacitors 44, 45 would not impair the arrangement operability.

It is apparent, however, that an inductive type of detector element could be employed in the protection arrangement instead of a capacitive detector element.

In this case, if one desires that the remainder of the protection arrangement be left unaltered, the inductive detector element would be substituted in the diagram of FIG. 3 for the resistor 43 and a resistor of a suitable value substituted for the capacitors 44, 45.

It would also be possible to replace the resistor 46 with an inductor, and the capacitors 47, 48 with resistive elements whose resistance can be controlled.

Figure 4:
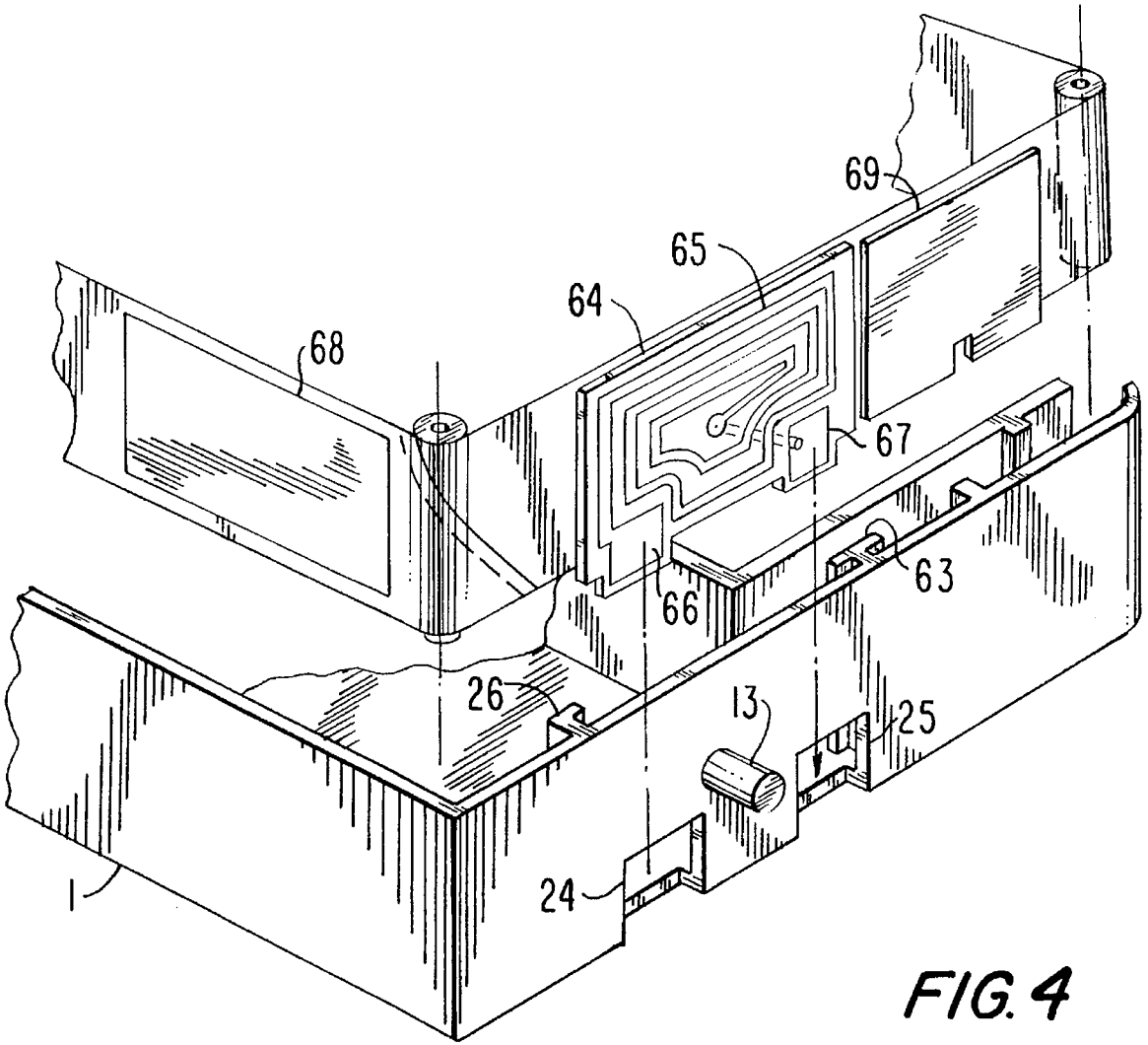
FIG. 4 shows in exploded perspective view a portion of the cartridge in FIG. 1, as modified in accordance with a second embodiment of the present invention.

FIG. 4 is am exploded perspective view of a preferred embodiment of an inductive detector element for an endless ink ribbon cartridge, and of a portion of the cartridge containing it.

In FIG. 4, the box-type body 1 is provided with two openings 24, 25 located close to the pin 13, exactly as shown in FIG. 2.

Inner ribs 26 and 63 form two parallel retaining guides whereinto the opposed edges of a printed circuit board 64 are fitted which have a winding 65 thereon being formed with at least one coil and terminated with two contact pads 66, 67 adapted for access from outside through the openings 24, 25.

The winding 65 is characterized by an inductance which increases significantly when a conductive strip 68 carried on the inked ribbon is brought before the plate by the ribbon movement.

The strip 68 forms a closed-loop coil which is coupled to the coil 65.

Due to the mutual inductance between the coils, the inductance oil the detector element, to which a reactance corresponds dependent on the supply frequency of the coil, increases significantly and can be readily detected by means of the electronic circuits previously described or of some equivalent electronic circuits.

Here again, the detector element will function with no need for an electric connection through the ribbon, and is simple, reliable and extremely low in cost.

A friction pad 69, consisting of a metal plate arranged adjacent to the printed circuit, conventionally ensures that the outgoing ribbon from the cartridge is kept tensioned, at the mere expense of a limited inductive coupling to the printed circuit which would not impair its responsiveness.

What I claim is:

1. A protection arrangement for an endless inked ribbon cartridge comprising:

an oscillator for generating a periodic pulsive signal, a reference integrator network having a predetermined first, time constant and being supplied said periodic pulsive signal, a measuring integrator network being supplied said periodic pulsive signal and being coupled to a varying reactance type detector element accommodated within said cartridge, said detector element detecting a varying reactance element attached to an inked ribbon of said cartridge when said varying reactance element runs close past said detector element, said measuring integrator network having a second time constant the value of which depends at least in part on said detector element, and circuit means connected to said reference network and said measuring network for recognizing variations of the second time constant from the first time constant.

2. The protection arrangement of claim 1, wherein said circuit means comprises a feedback network for equalizing said first time constant and said second time constant, said feedback network having a time constant greater than a rate of change of said second time constant due to said varying-reactance element attached to said inked ribbon running close past said detector element.

3. The protection arrangement of claim 2, wherein said reference integrator network comprises a variable capacitance diode and said feedback network comprises a means of moving a reverse bias voltage of said diode.

4. A cartridge of an endless ink ribbon formed into a continuous loop by splicing together two ends thereof, having a ribbon housing with an inlet opening and an outlet opening for said ribbon to exit said housing, said ribbon coming out of said cartridge along a predetermined path lying adjacent to a side wall of said housing, said cartridge including a reactance type of detector element carried on said side wall, disposed in said predetermined path, and provided with a pair of electric contact terminals, said detector element comprising a pair of conductive plates arranged adjacent to each other along said predetermined path, carried on said side wall, and being each provided with an electric contact pad forming one terminal of said pair, said housing for the inked ribbon having a pair of openings providing access to said terminals, and said inked ribbon carrying, at a predetermined location relative to said splice, a conductive strip, which conductive strip when overlying said detector element is effective to change the reactance of said element.

5. The cartridge of claim 4, wherein said conductive strip is disposed on one side of said ribbon facing said pair of conductive plates, said cartridge being provided with a dielectric means of insulating said conductive strip from at least one of said conductive plates.

6. The cartridge of claim 4, wherein at least one of said conductive plates is pre-loaded elastically and forms a friction pad acting on said inked ribbon.

7. The cartridge of claim 4, wherein said electric contact pad is formed by bending a lug on said conductive plates to a U-shape which is then snapped fixedly into one opening of said opening pair.

* * * * *